US010781627B2

(12) United States Patent
Martens

(10) Patent No.: US 10,781,627 B2
(45) Date of Patent: Sep. 22, 2020

(54) HINGED UPPER DOOR FRAME MEMBER

(71) Applicant: Joseph Martens, Stonefort, IL (US)

(72) Inventor: Joseph Martens, Stonefort, IL (US)

( * ) Notice: Subject to any disclaimer, the term of this patent is extended or adjusted under 35 U.S.C. 154(b) by 0 days.

(21) Appl. No.: 16/544,461

(22) Filed: Aug. 19, 2019

(65) Prior Publication Data

US 2020/0003001 A1 Jan. 2, 2020

Related U.S. Application Data

(63) Continuation-in-part of application No. 15/901,394, filed on Feb. 21, 2018, now abandoned.

(51) Int. Cl.

| | |
|---|---|
| ***E06B 3/38*** | (2006.01) |
| ***E05F 11/04*** | (2006.01) |
| ***E04B 1/343*** | (2006.01) |

(52) U.S. Cl.

CPC ..... *E06B 3/38* (2013.01); *E04B 1/34336* (2013.01); *E05F 11/04* (2013.01)

(58) Field of Classification Search

CPC ... E06B 3/38; E04B 1/34336; B65G 69/2811; E05F 11/04; B60J 5/0498

USPC ..... 49/72, 402, 61, 67, 63, 142, 366, 367, 49/371, 103, 104; 52/204.1, 213, 455, 52/457, 458, 456, 656.4

See application file for complete search history.

(56) References Cited

U.S. PATENT DOCUMENTS

| | | | | | |
|---|---|---|---|---|---|
| 577,960 | A * | 3/1897 | Jacobs | B61D 19/005 | 49/37 |
| 1,347,283 | A * | 7/1920 | Mackey | B61D 19/001 | 49/142 |
| 1,919,328 | A * | 7/1933 | Hansen | E05C 9/08 | 292/218 |
| 2,249,932 | A * | 7/1941 | Beal | B62D 33/0273 | 49/109 |
| 2,422,912 | A * | 6/1947 | Kling | B60J 5/103 | 49/367 |
| 2,541,288 | A * | 2/1951 | Rice | B60P 3/07 | 414/537 |
| 2,606,786 | A * | 8/1952 | Howard | B60J 5/0498 | 296/61 |
| 3,667,172 | A * | 6/1972 | Erickson | E04H 6/02 | 52/64 |
| 3,919,808 | A * | 11/1975 | Simmons | E05C 7/04 | 49/367 |
| 3,984,014 | A * | 10/1976 | Pohl | B60P 1/4442 | 414/546 |
| 4,024,671 | A * | 5/1977 | Isobe | E05F 17/00 | 49/104 |
| 4,127,300 | A * | 11/1978 | Melley | F02B 63/04 | 290/1 R |
| 4,143,281 | A * | 3/1979 | Appley | A61G 3/061 | 296/146.12 |

(Continued)

*Primary Examiner* — Brent W Herring

(74) *Attorney, Agent, or Firm* — Sandberg Phoenix & von Gontard, P.C.

(57) ABSTRACT

An improvement in a portable building (B) comprises a ramp door (100) installed in an opening (O) formed in a sidewall (S) of the building. An upper door frame member (106) is hingedly installed to the side of building so to cover the upper end of the ramp door. When the member is in a vertical position, it prevents the ramp door from being lowered; but when the member is rotated to a horizontal position, it unblocks the upper end of the door so the door can be lowered and raised.

8 Claims, 3 Drawing Sheets

(56) References Cited

U.S. PATENT DOCUMENTS

| | | | | | |
|---|---|---|---|---|---|
| 4,252,491 | A * | 2/1981 | Hock | B60P 1/4435 | 187/244 |
| 4,268,084 | A * | 5/1981 | Peters | B60J 5/0498 | 296/148 |
| 5,577,793 | A * | 11/1996 | Kobasic | B60J 5/0498 | 296/146.12 |
| 5,601,131 | A * | 2/1997 | Morris | E05B 65/0021 | 160/207 |
| 5,833,294 | A * | 11/1998 | Williams | B60P 3/14 | 296/24.32 |
| 6,010,298 | A * | 1/2000 | Cohn | A61G 3/061 | 414/522 |
| 6,186,733 | B1 * | 2/2001 | Lewis | A61G 3/061 | 414/537 |
| 6,203,265 | B1 * | 3/2001 | Cohn | A61G 3/061 | 414/537 |
| 6,210,098 | B1 * | 4/2001 | Cohn | A61G 3/061 | 414/537 |
| 6,238,168 | B1 * | 5/2001 | Cohn | A61G 3/061 | 414/537 |
| 6,409,458 | B1 * | 6/2002 | Cohn | A61G 3/061 | 14/71.1 |
| 7,322,636 | B1 * | 1/2008 | Woodhouse | B60J 5/0473 | 296/146.1 |
| 7,669,797 | B2 * | 3/2010 | Yada | B64C 1/24 | 192/69.7 |
| 2011/0036015 | A1 * | 2/2011 | Archer | E05D 15/262 | 49/197 |

* cited by examiner

HINGED UPPER DOOR FRAME MEMBER

CROSS REFERENCE TO RELATED APPLICATIONS

This application is a continuation-in-part (CIP) application claiming priority from U.S. patent application Ser. No. 15/901,394 filed Feb. 21, 2018, the disclosure of which is hereby incorporated by reference.

STATEMENT REGARDING FEDERALLY SPONSORED RESEARCH OR DEVELOPMENT

N/A

BACKGROUND OF THE INVENTION

This invention is directed to portable buildings such as storage sheds, storage barns, etc.; and, more particularly, to a hinged upper door frame member for a door installed in such structures for enabling movement of people and items into and out of them.

Portable storage buildings are structures used as sheds or barns and can range in size from 10'×16' or smaller, up to 16'×44' or larger. The buildings are roofed structures constructed of wood and/or metal and can include skids located beneath the building by which the structure is movable from one location to another.

The buildings are used to house or store a variety of items including, for example, lawn and riding mowers, small tractors and other earth moving equipment. The buildings can also serve as workshops for wood, metal working, equipment repair, and hobby crafts, as well as to store tools and various other implements and items. Regardless of the size of the building, it will typically have at least one door and/or window.

A problem with conventional portable structures is the inability to store or house large or heavy pieces of equipment which, like a riding mower, for example, may conveniently fit within the building but which also needs to easily pass through an entryway for the structure. Larger buildings used as garages and barns may have side-by-side hinged door arrangements by which both doors can be pulled open to expose a large enough entryway that a vehicle or large piece of equipment is readily moved into the structure. Garages often have over-head door installations, usually electrically powered, by which a door is raised and lowered to provide an entry into the facility. These conventional arrangements have certain drawbacks with regard to portable structures. For example, portable structures are not necessarily wired for electricity. Also, the framing required to support side-by-side or overhead doors may increase the cost of fabricating the structure so it is not as economical as it could be.

BRIEF SUMMARY OF THE INVENTION

The present disclosure is directed to a ramp door installed in a portable structure and having a hinged upper door frame member. In a raised, closed position, the door cover covers an opening formed in the side of a portable building, the opening being sufficiently large for items to be stored in the structure to be readily moved or driven into the building. In this upright door closed position, the door frame member is in a vertical position resting adjacent the upper outer end of the door and preventing the door from being lowered. The upper door frame member is hinged for rotation outwardly from this vertical position to a generally horizontal position which is clear of the upper end of the door, allowing the door to be lowered closed and raised.

The ramp door is hingedly connected to the structure to lower and raise the door and a mechanism is provided by which a user can do so in a controlled manner. A panel is mounted to the interior top portion of the door and extends outwardly as the door is fully lowered to rest on the ground and complete formation of a ramp by which items can be brought into or removed from the building. The hinged upper door member also has an associated mechanism by which the member is moved from its vertical to horizontal position, or from the horizontal back to the vertical position in a controlled manner. The two mechanisms are operable in a sequential manner so when the door is closed, the associated mechanisms first move the member from its vertical to a horizontal position to unblock the door which is then lowered. When the door is to be closed, the mechanism first moves the door to its vertical position and then lowers the hinged member to its vertical position to block the door in its closed position.

The hinged door member extends across the width of the door and may include windows to allow light into the structure.

The ramp door and hinged upper member are separate elements and are made of a wood and/or metal and/or fiberglass construction.

Other objects and features will be in part apparent and in part pointed out hereinafter.

BRIEF DESCRIPTION OF THE SEVERAL VIEWS OF THE DRAWINGS

The accompanying figures, together with detailed description which follows, form part of the specification and illustrate the various embodiments described in the specification.

Corresponding reference characters indicate corresponding parts throughout the several views of the drawings.

DETAILED DESCRIPTION OF INVENTION

Figure 1:
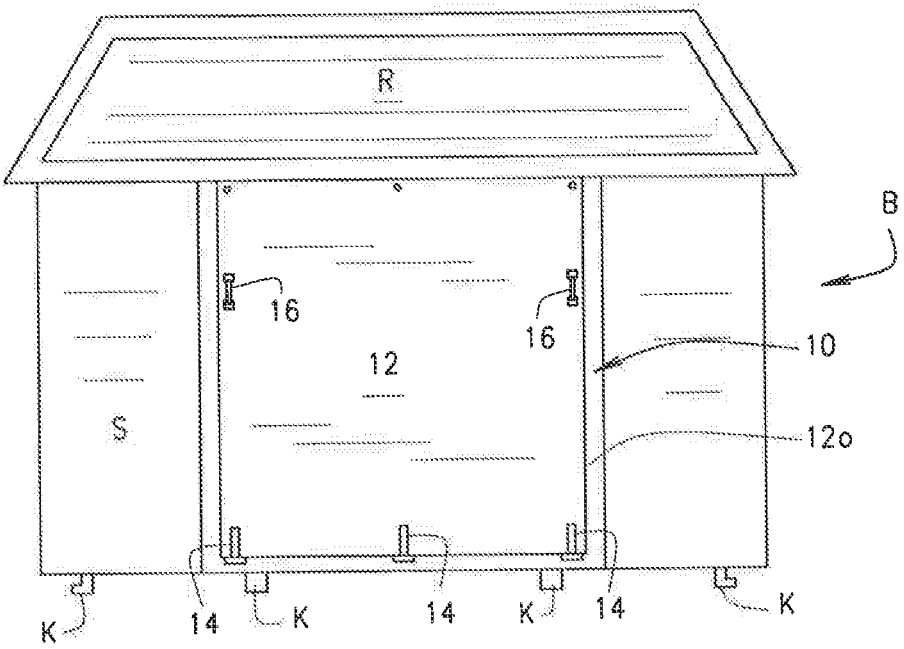
FIG. 1 is an elevation view of one side of portable building in which a ramp door of the present invention is installed.

The following detailed description illustrates the invention by way of example and not by way of limitation. This description clearly enables one skilled in the art to make and use the invention, and describes several embodiments, adaptations, variations, alternatives and uses of the invention, including what is presently believed to be the best mode of carrying out the invention. Additionally, it is to be understood that the invention is not limited in its application to the details of construction and the arrangement of components set forth in the following description or illustrated in the drawings. The invention is capable of other embodiments and of being practiced or carried out in various ways. Also, it will be understood that the phraseology and terminology used herein is for the purpose of description and should not be regarded as limiting.

Referring to the drawings, a portable building B includes sidewalls S, a roof R, a floor F (see FIG. 4), and a plurality of skids K installed beneath the floor and on which the building rests. The skids are used when the portable building is towed from one site to another. As previously noted portable building B is available in various sizes and is used for a variety of purposes. The building is of a post and beam construction (not described) and is made of wood and/or metal. The building typically has at least one door and window which are not shown in the drawings.

Figure 3:
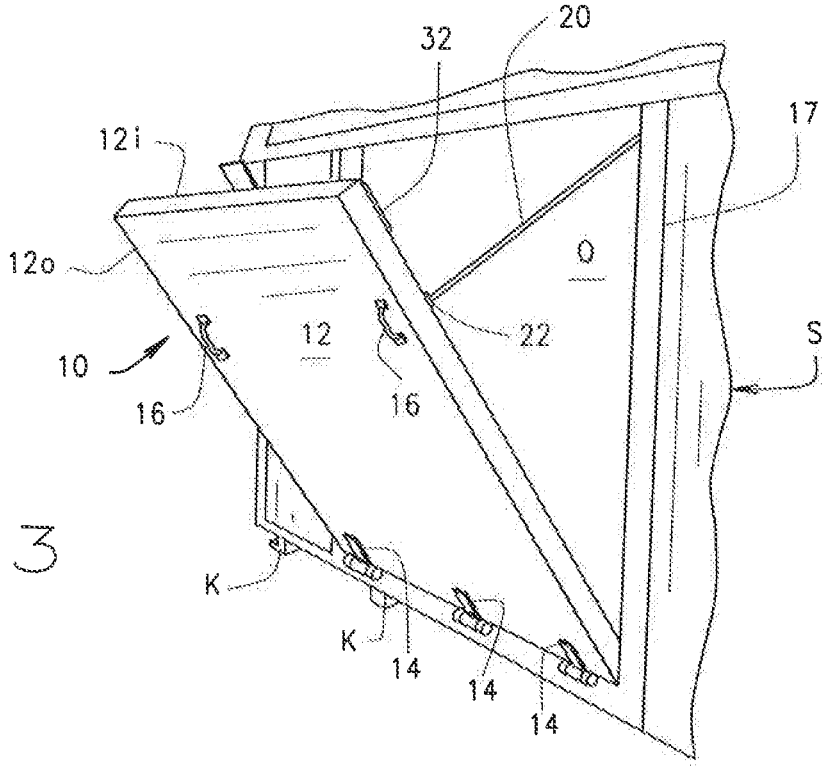
FIG. 3 is view of the building illustrating the ramp door in a partially lowered or raised position.

An improvement to portable building B comprises a door ramp indicated generally 10 and which is installed in an opening O (see FIGS. 3 and 4) formed in one of the sidewalls S. Door ramp 10 includes a generally rectangular shaped door 12 sized to fit in opening O and close the opening when the door is in a raised position (see FIG. 1). The door is made of wood or metal or fiberglass or a combination of these materials. While construction of door 12 is not described, those skilled in the art will appreciate that the door can be a reinforced door to accommodate the storing or removal of heavy or bulky items.

To raise and lower door 12, the base of the door is hingedly attached to the sidewall in which opening O is formed, the bottom of the door being hinged to a frame piece 17 adjacent floor F. As shown in FIG. 1, inverted T-shaped hinges 14 connect the base of door 12 with door frame 17, three such hinges being used for this purpose. Two of the hinges are adjacent the sides of the door with the third hinge being in the middle. The mounting of door ramp 12 is such that door pivots approximately 6"-12" off the bottom of the skids K.

Two handles 16 are attached to the outer surface of door 12 along opposites of the door. The handles are attached to the exterior or outer face 12*o* of the door at a height that allows one or two people to each conveniently grasp a handle and pull on it to lower or open door 12, or push on it to raise the door back to its closed position.

Figure 2:
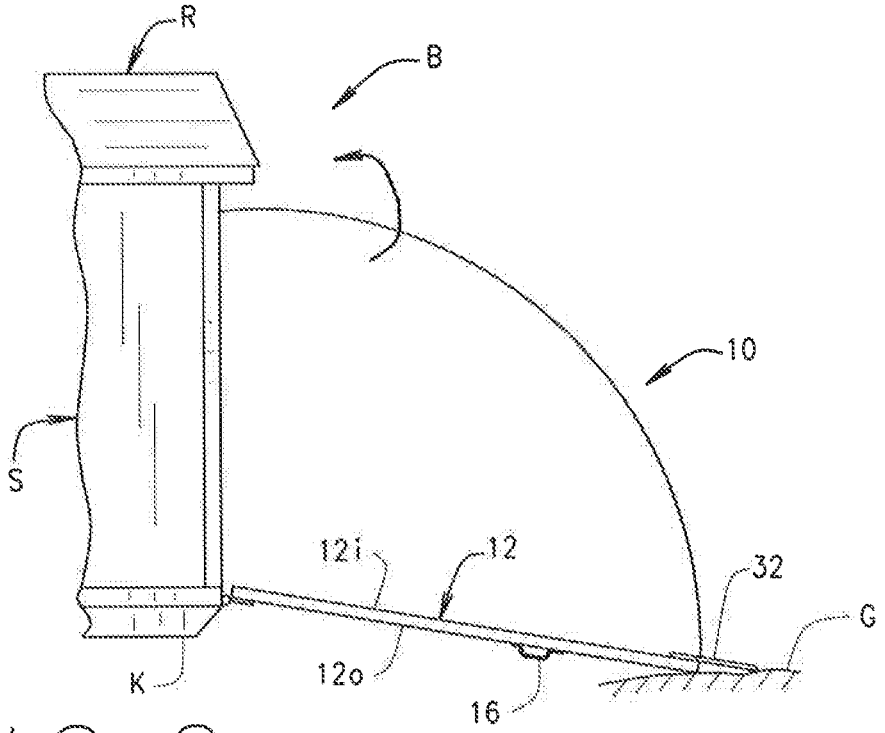
FIG. 2 is a partial side view of the building illustrating lowering and raising of the ramp door.
Figure 4:
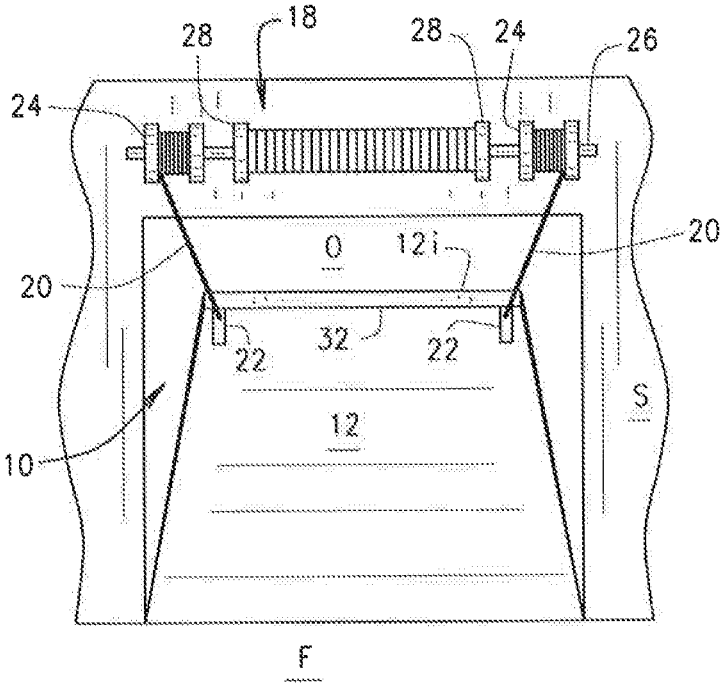
FIG. 4 is a view from the interior of the building illustrating the ramp door in a partially lowered or raised position.

A mechanism indicated generally 18 allows door 12 to be lowered and raised in a controlled manner. One end of a rope/chain/wire 20 is connected to the interior or inner face 12*i* of the door, on opposite sides of the door as shown in FIG. 4, by a bracket 22. Each rope/chain/wire is routed through a spool 24. There are two such spools each of which are respectively mounted on opposite ends of a rod 26 that extends across the top of opening O, above the opening. Rod 26 is rotatably supported by brackets 28 that attach to the interior face of sidewall S above the door opening. Mounted on rod 26 between the spools is a torsion spring 30 to facilitate lowering and raising door 12 by mechanism 18. As shown in FIG. 2, operation of mechanism 18 is such that when door 12 is fully lowered, the upper end of the door rests on the ground G with the other end of the door remaining adjacent floor F, thereby to form a ramp by which an item can easily be brought into or removed from portable building B.

In this latter regard, the improvement of the present invention further includes a panel 32 which extends across the width of door ramp 12. Panel 32 is hinged to the top of the door as shown in FIG. 4, and as the ramp door is lowered rotates outwardly or "flips-out" to complete formation of the ramp. That is, when door ramp 12 is fully lowered as shown in FIG. 2, panel 32 is extended outwardly from the top of the door with its outer end resting on the ground. This then makes for a smooth transition (no offset) between the ground and the ramp that is formed by the door, so there is no abrupt transition for articles being moved onto or off the ramp. Further, the panel helps counter any unevenness in the ground surface between the sides of door 12 when in its lowered position. Accordingly, in its extended, lowered position, door ramp 12 provides an angled or sloping surface up which items can be readily carried, loaded, or driven into, or out of, building B.

This feature helps prevent damage to items being stored or removed from potable building B by eliminating any bumps which might otherwise occur; or skewing of items because of any differences in heights between one side of the ramp and the other when the door is in its lowered position.

Figure 5:
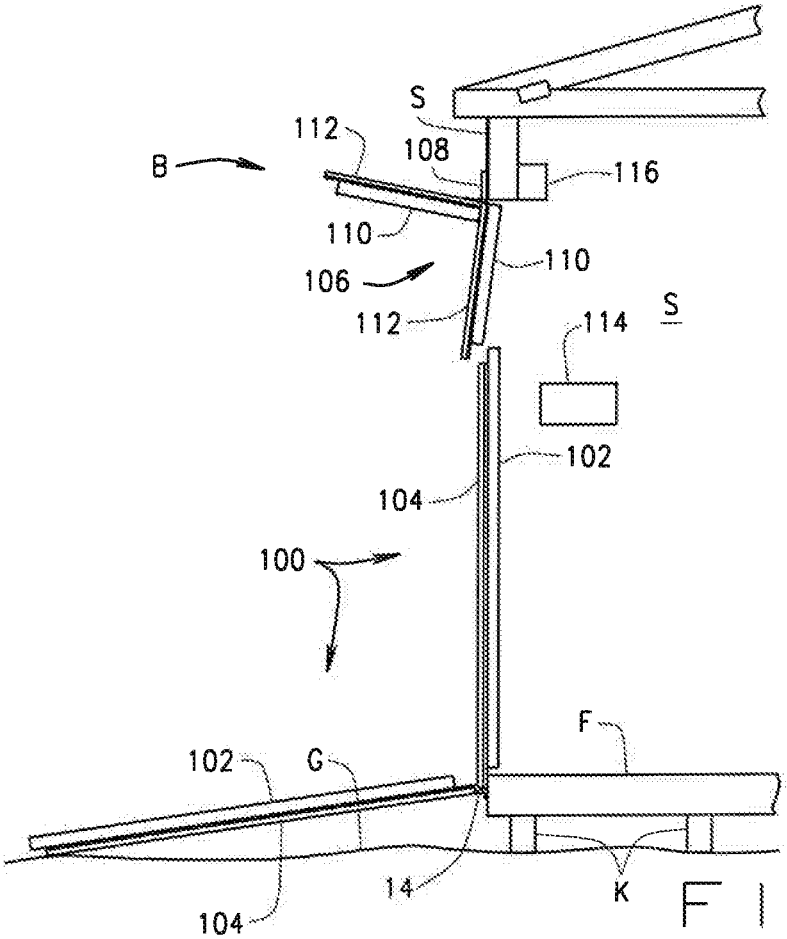
FIG. 5 is an elevation view of the ramp door with a hinged upper door frame member; and, FIG. 6A is frontal view of a plain frame member.
Figure 6A:
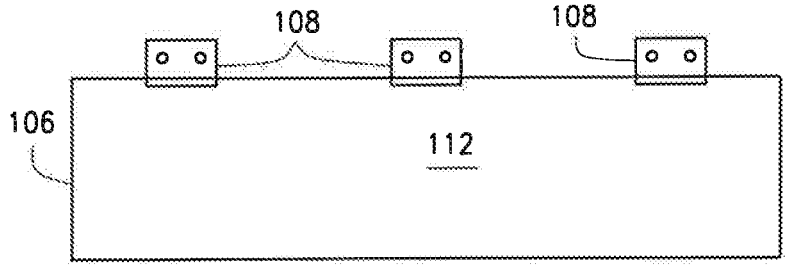
FIG. 6B is a similar view of a frame member in which windows are installed.
Figure 6B:
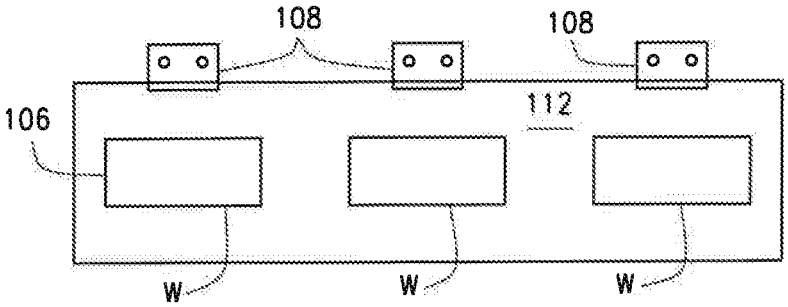

Referring now to FIGS. 5, 6A, and 6B, a second embodiment of the door ramp, indicated generally 100, includes a door comprised of an inner door member 102 and an outer, outwardly facing door member 104. Although not shown in the drawings, the outer face of member 104 may have a decorative design in keeping with overall appearance of the outside of building B. As shown in FIG. 5 inner door member 102 extends above the height of outer door member 104 leaving an open space above the upper edge of door member 104.

An upper door frame member 106 is hingedly mounted to the outer surface of building B and extends across the width of the door. As shown in FIGS. 6A and 6B, a plurality of hinges 108 are attached to the upper end of door frame member 106 and are generally uniformly spaced across the width of the member. Each hinge 108 has one leaf secured to the outer surface of member 106, with the other leaf being secured to the outside of building B. This allows hinged upper door frame member 106 to be rotated from a vertical position covering the upper portion of door 100, when the door is in its raised, closed position, by at least 90° to a generally horizontal position as shown in FIG. 5. When upper door frame member 106 is in its horizontal position, door 100 can be lowered and raised.

As further shown in FIGS. 6A and 6B, upper door frame member 106 can either be of a plain construction (see FIG. 6A); or, one or more windows W are installed in the member (see FIG. 6B) so to allow light into the structure.

Referring again to FIG. 5, upper door frame member 106 comprises an inner frame member 110 and an outer frame member 112. Inner frame member 110 is shorter than outer frame member 112. As shown in the drawing, assembly of upper door frame member 106 is such that when the member is in its vertical position, the respective lower ends of frame members 110 and 112 are adjacent the upper ends of frame members 102 and 104 of door 100. Again, when upper door frame member 106 is in its vertical position, it blocks movement of door 100.

A control mechanism 114 is mounted to a sidewall S of building B, either on the exterior or interior of the building for controlling operation of upper door frame member 106. In one embodiment activation of control mechanism 114, which can be an electrical or electronic device, results in operation of, for example, a motor or solenoid 116 to move hinged upper door frame member 106 from its vertical to its horizontal position. The mechanism 18 previously described is then used to lower and raise door 100. In an alternate embodiment, activation of control mechanism 114 first energizes the motor or solenoid to raise upper door frame member 106 and then sequentially lower door 100 through use of another, similar mechanism (not shown). When door 100 is to be raised and closed, activating mechanism 114 first results in door 100 being raised to its upright, vertical position with motor or solenoid 116 then being sequentially activated to move upper door frame member 106 to its vertical, door blocking position.

In view of the above, it will be seen that the several objects and advantages of the present disclosure have been achieved and other advantageous results have been obtained.

Having thus described the invention, what is claimed and desired to be secured by Letters Patent is:

1. A portable building comprising:

a plurality of sidewalls, a roof, a floor, and a plurality of skids installed beneath the floor and on which the building rests, one of the plurality of sidewalls defining an opening therein:

a hinged upper frame door member installed on the one of the plurality of sidewalls at an upper end of the opening, the hinged upper frame door member having an upper end and a lower end, the hinged upper frame door member being hinged at the upper end;

a door being installed on the one of the plurality of sidewalls at a lower end of the opening, the door having an upper end and a lower end, the door being hinged at the lower end, wherein the upper door frame member is movable from a first and generally vertical position to a second and generally horizontal position, the door being moveable from a closed generally vertical position and an open position, and adapted and configured to serve as a ramp when in the open position;

the door and the hinged upper frame door member both being sized such that when the door is in the closed position and the hinged upper frame door member is in the first position, the door and the hinged upper frame door member meet at a point within the opening, the point being closer to the roof than the floor;

the hinged upper frame door member being adapted and configured to prevent the door from moving from the closed position to the open position when the hinged upper frame door member is in the first position, wherein the hinged upper frame door member is sized to interfere with the door such that the door is prevented from moving from the closed position to the open position when the hinged upper frame door member is in the first position; and a control mechanism operable by a user to effect movement of the hinged upper door frame member to both open and close the hinged upper door frame member and thereby move the member between its vertical and horizontal positions the control mechanism configured to secure the door in the closed position, the control mechanism comprising a rotatable rod, a spool coupled to the rotatable rod, and a torsion spring coupled to the rotatable rod, and at least one of a rope, a chain, or a wire, the at least one of a rope, a chain, or a wire being spooled on the spool and coupled to the door such that the control mechanism is adapted and configured to actuate the door, the control mechanism further comprising a separate at least one of a motor or solenoid adapted and configured to actuate the hinged upper door frame member independently of the door.

2. A portable building in accordance with claim 1 in which the door is comprised of an inner door member and an outer, outwardly facing door member, the inner door member extending above the height of the outer door member so to leave an open space above an upper end of the outer door member and the upper end of the inner door member.

3. A portable building in accordance with claim 2 in which the hinged upper door frame member comprises an inner frame member and an outer frame member, the inner frame member being shorter than the outer frame member so when the hinged upper door frame member is in its vertical position, the respective lower ends of the inner and outer upper door frame members are adjacent the respective upper ends of the inner and outer frame members of the door for the hinged upper door frame member to block movement of the door.

4. A portable building in accordance with claim 3 wherein the control mechanism is mounted to either an exterior or interior of one of the plurality of sidewalls of the building for controlling operation of the upper door frame member, the control mechanism being operable to move the upper door frame member between its first and second positions.

5. A portable building in accordance with claim 4 in which the control mechanism is configured to operate the upper door frame member and the door sequentially to lower and raise the door upon activation of the control mechanism, the control mechanism configured such that when the upper door frame member is in its vertical position, the control mechanism first moves the hinged upper frame door member to its horizontal position and then sequentially lowers the door, and when the door is to be raised, the control mechanism first raises the door to its upright vertical position and then sequentially moves the upper door frame member to its vertical, door blocking position.

6. A portable building in accordance with claim 1 further including a plurality of hinges attached to the upper end of the hinged upper door frame member and generally uniformly spaced across the width of the member, each hinge having one leaf secured to an outer surface of the member with the other leaf being secured to the outside of the building.

7. A portable building in accordance with claim 1 in which the upper door frame member has at least one window installed in it to allow light into the interior of the building.

8. A portable building in accordance with claim 1, wherein the hinged upper frame door member is adapted and configured to rotate at least 90 degrees between the first and second positions.

* * * * *